US006766861B2

(12) United States Patent
Koen et al.

(10) Patent No.: US 6,766,861 B2
(45) Date of Patent: Jul. 27, 2004

(54) STACKABLE GUIDE FUNNEL SYSTEM AND METHOD

(75) Inventors: Kevin R. Koen, Cypress, TX (US); Gilbert P. Mican, Sealy, TX (US); Arjin Nolan, Houston, TX (US); Joseph W. Pallini, Jr., Tomball, TX (US); Kim H. Phan, Houston, TX (US); Andrew H. Roberts, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 29 days.

(21) Appl. No.: 10/247,669

(22) Filed: Sep. 19, 2002

(65) Prior Publication Data

US 2003/0051877 A1 Mar. 20, 2003

Related U.S. Application Data

(60) Provisional application No. 60/323,229, filed on Sep. 19, 2001.

(51) Int. Cl.[7] ..... E21B 33/076; E21B 33/035

(52) U.S. Cl. ..... 166/345; 166/349; 166/366; 285/39

(58) Field of Search ..... 166/344, 345, 166/349, 351, 360, 366; 285/24, 27, 39

(56) References Cited

U.S. PATENT DOCUMENTS 4,167,215 A * 9/1979 Thorne ..... 166/341
4,286,665 A 9/1981 Walker
4,343,495 A * 8/1982 Nobileau et al. ..... 285/23
4,397,357 A * 8/1983 Hettinger ..... 166/345
4,427,072 A * 1/1984 Lawson ..... 166/345
4,541,753 A 9/1985 Langner
4,669,916 A * 6/1987 White et al. ..... 405/224
4,696,493 A * 9/1987 Brammer ..... 285/3
4,822,212 A * 4/1989 Hall et al. ..... 405/227
4,842,075 A * 6/1989 Kalvenes et al. ..... 166/341
5,255,744 A 10/1993 Silva
5,320,175 A 6/1994 Ritter et al.
5,791,418 A * 8/1998 Milberger et al. ..... 166/368
5,868,203 A * 2/1999 Cunningham ..... 166/344
6,227,301 B1 * 5/2001 Edwards et al. ..... 166/344
6,336,508 B1 * 1/2002 Guinn ..... 166/339
6,352,114 B1 * 3/2002 Toalson et al. ..... 166/343

* cited by examiner

*Primary Examiner*—David Bagnell
*Assistant Examiner*—Shane Bomar
(74) *Attorney, Agent, or Firm*—Bracewell & Patterson, L.L.P.

(57) ABSTRACT

A subsea production system and method includes a wellhead field having multiple wellheads and utilizes a stackable guide funnel system for sequential tying back of those wellheads. A storage frame retains several guide funnels that are nestably stacked one upon the other. The frame is made up of a plurality of guide members that are secured to the exposed tubular conductor of a wellhead. A pair of annular rings surrounds portions of each of the guide members. A riser having a riser connector is lowered to the central location. The riser connector latches onto the uppermost guide funnel within the frame. The riser, together with the affixed funnel, is then lifted upwardly, removing the affixed funnel from the frame. The riser is then moved laterally through the sea until the funnel and riser are proximate a second wellhead within the wellhead field.

15 Claims, 5 Drawing Sheets

STACKABLE GUIDE FUNNEL SYSTEM AND METHOD

CROSS-REFERENCE TO RELATED APPLICATIONS

This application claims the priority of U.S. Provisional Patent Application Serial No. 60/323,229 filed on Sep. 19, 2001.

BACKGROUND OF THE INVENTION

1. Field of the Invention

The invention relates generally to systems and methods for landing and tying back riser strings in subsea wellhead fields containing multiple wellheads.

2. Description of the Related Art

Prior art methods are known for landing and tying back risers using funnels to land the riser onto a subsea wellhead housing. The funnels are helpful in docking the riser onto the wellhead housing and guiding the riser into the center of the docking opening on the housing. However, these methods are problematic since the funnel must normally be disposed though the moonpool of a floating vessel, and this can be quite difficult, particularly where the floating vessel is very long, such as in the case of a spar. This may result in damage to the funnel and make it difficult to ultimately land and dock the riser.

SUMMARY OF THE INVENTION

A subsea production system is described. The system includes a wellhead field having multiple wellheads and utilizes a stackable guide funnel system for sequential tying back of those wellheads. In a preferred embodiment, at least one of the wellheads is provided with a storage frame that retains several guide funnels that are nestably stacked one upon the other. The guide funnels may be sequentially removed from the frame by a riser connector having a complimentary latching mechanism. In a preferred embodiment, the frame is made up of a plurality of guide members that are secured to the exposed tubular conductor of the wellhead. A pair of annular rings surrounds portions of each of the guide members. The upper end of the frame is outwardly flared to assist in landing of the riser connector. The lower ring assists in landing the stackable guide funnel structure onto the wellhead.

A method is also described for sequential completion of wellheads within a wellhead field. In the method, a plurality of guide funnels are propositioned at one or more central locations upon the sea floor. The guide funnels are configured at the central location to permit sequential retreival. In a presently preferred embodiment, the guide funnels are nestably stacked one upon the other and retained within a storage frame for ease of retreival. A riser having a riser connector is lowered to the central location. The riser connector latches onto the uppermost guide funnel within the frame. The riser, together with the affixed funnel, is then lifted upwardly, removing the affixed funnel from the frame. The riser is then moved laterally through the sea until the funnel and riser are proximate a second wellhead within the wellhead field. The riser next is lowered to mate the riser connector with the tubular conductor of the second wellhead. The skirt of the guide funnel assists in this mating operation by guiding the tubular conductor toward the riser conductor. A second riser can then be lowered from the surface and latched into the next guide funnel available at the central location.

DETAILED DESCRIPTION OF THE PREFERRED EMBODIMENTS

Figure 1:
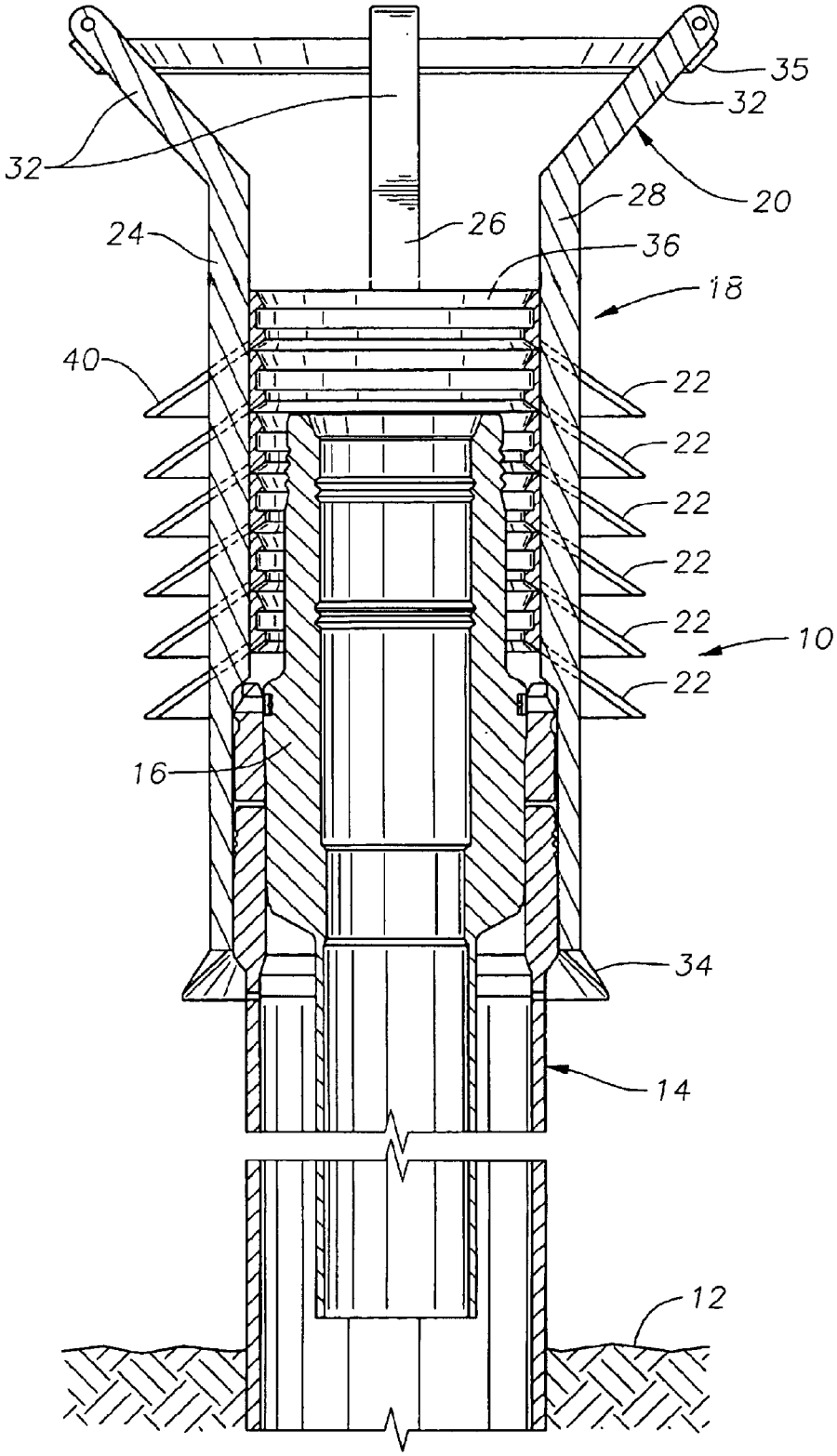
FIG. 1 is a side, cross-sectional view of an exemplary funnel stacking arrangement incorporated atop a subsea wellhead.
Figure 3:
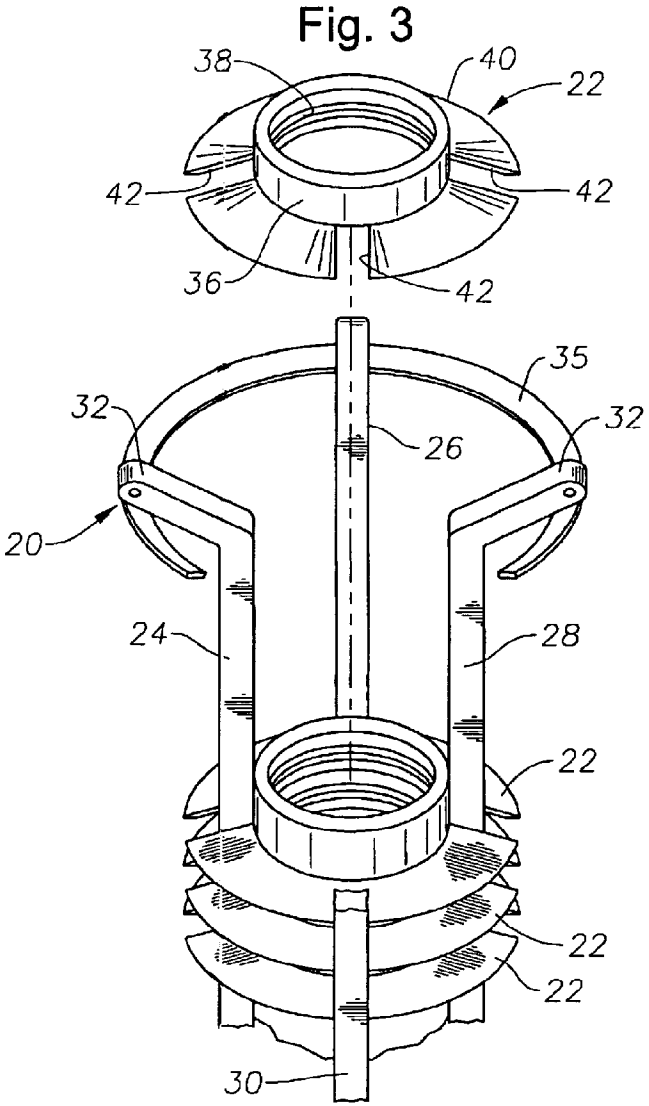
FIG. 3 is an isometric view illustrating an exemplary funnel stacking arrangement.
Figure 2:
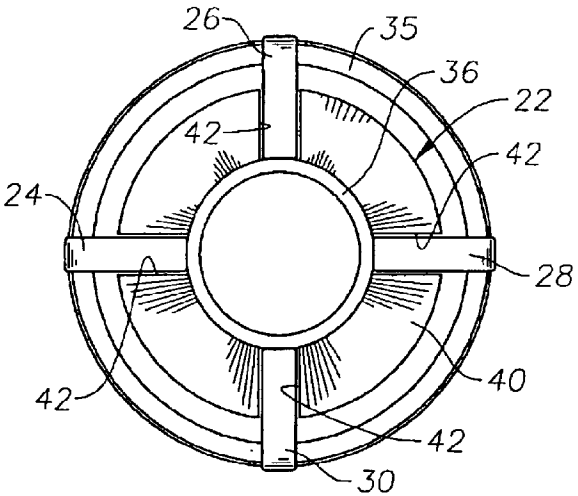
FIG. 2 is a plan view of an exemplary funnel.

FIGS. 1–7 illustrate a system and method for docking and affixing a plurality of risers within a plurality of subsea wellheads. FIG. 1 shows a first exemplary wellhead 10 that is disposed within the sea floor 12. The wellhead 10 is one of several wellheads in a field of two or more subsea wellheads making up a subsea production system. The wellhead 10 has a tubular conductor 14 that extends into the sea floor 12 to a hydrocarbon formation below. A high pressure wellhead housing 16 is retained within the conductor 14. It is pointed out that the other wellheads in the wellhead field are constructed in this manner as well.

The wellhead 10 is a hub wellhead housing in that it incorporates a funnel stacking arrangement, generally indicated at 18, wherein a plurality of landing funnels are removably stored in order to be latched onto the riser connector for a riser and then used to land and secure the riser to another of the wellheads in the wellhead field. The funnel stacking arrangement 18 features a frame 20 that is disposed on the wellhead 10 and retains a plurality of individual funnels 22. The construction of the frame 20 and funnels 22 can be more clearly appreciated with reference to FIGS. 2, 3 and 5. The frame 20 consists of four substantially vertically disposed keeper members 24, 26, 28, and 30 that are secured to the wellhead 10 and spaced apart from one another angularly. It is pointed out that the upper portion 32 of each keeper member 24, 26, 28 and 30 is bent at an angle radially outwardly. The four keeper members 24, 26, 28 and 30 are affixed to one another using a lower annular ring 34 that interconnects their lower ends and an upper annular ring 35 that interconnects the upper ends of the keeper members 24, 26, 28, and 30.

Figure 5:
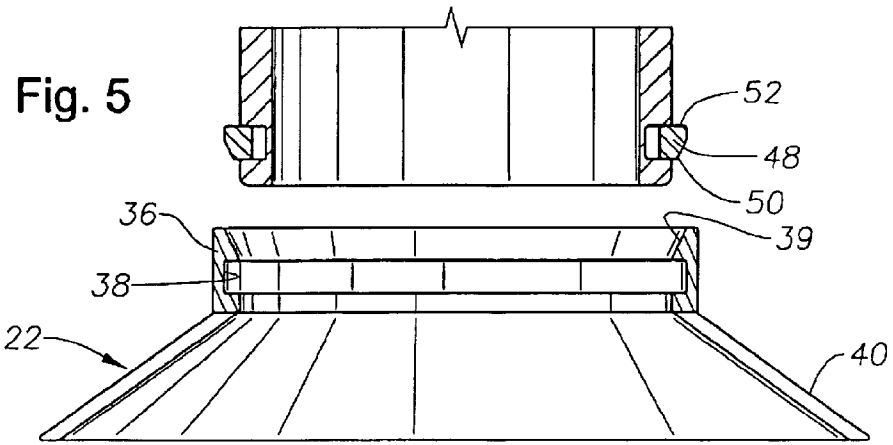
FIG. 5 is a side cross-sectional detail showing an exemplary latching arrangement used to connect the riser connector and a funnel.

Each of the funnels 22 includes an upper, solid annular ring 36 having an internal groove 38 (see FIG. 5). A tapered camming shoulder 39 is located above the groove 38, as shown in FIG. 5. A flared skirt 40 is affixed to the lower end of the annular ring 36. The skirt 40 of each funnel 22 has four radial slots 42 oriented at approximately 90 degree angles to one another. The slots 42 are sized, shaped and located to receive therein one of keeper members 24, 26, 28 or 30 of the frame 20. As is apparent from FIGS. 1, 3, 4, and 6, the funnels 22 may be retained within the frame 20 by stacking the funnels 22 one atop another with the skirts 40 directed downwardly. The keeper members 24, 26, 28 and 30 retain the funnels 22 together in a central location atop the wellhead 10.

Figure 4:
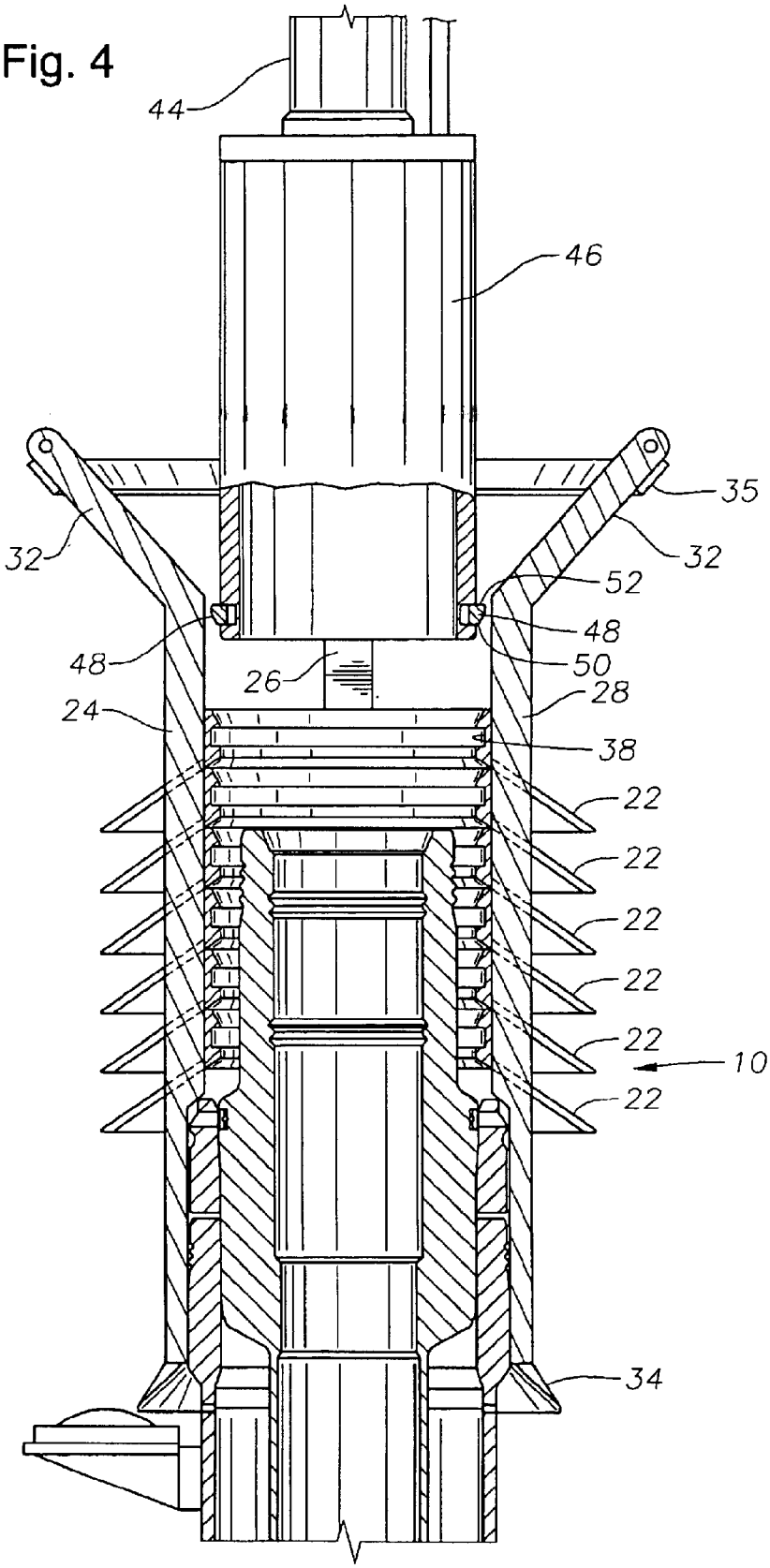
FIG. 4 is a side, cross-sectional view depicting a riser connector being lowered into the funnel stacking arrangement.

FIG. 4 depicts the lower end of a riser 44 having a riser connector 46 affixed thereto. The riser connector 46 includes a radially outwardly-biased C-ring (shown at 48). The profile of the C-ring 48 presents a downwardly and outwardly tapered camming shoulder 50 and an upwardly projecting stop shoulder 52.

In operation, the riser 44 is lowered from a floating platform (not shown) toward the wellhead 10. FIG. 4 depicts this. The outwardly bent portions 32 of the keeper member 24, 26, 28, 30 tend to centralize the connector 46 and help guide it radially inwardly toward the funnels 22. The connector 46 latches into the top funnel 22 of the stack when the camming shoulder 50 of the C-ring 48 engages the camming shoulder 39 of the funnel 22. The C-ring 48 is cammed radially inwardly until the internal spring forces cause the C-ring 48 to spring radially outwardly into the groove of the funnel 22.

Figure 6:
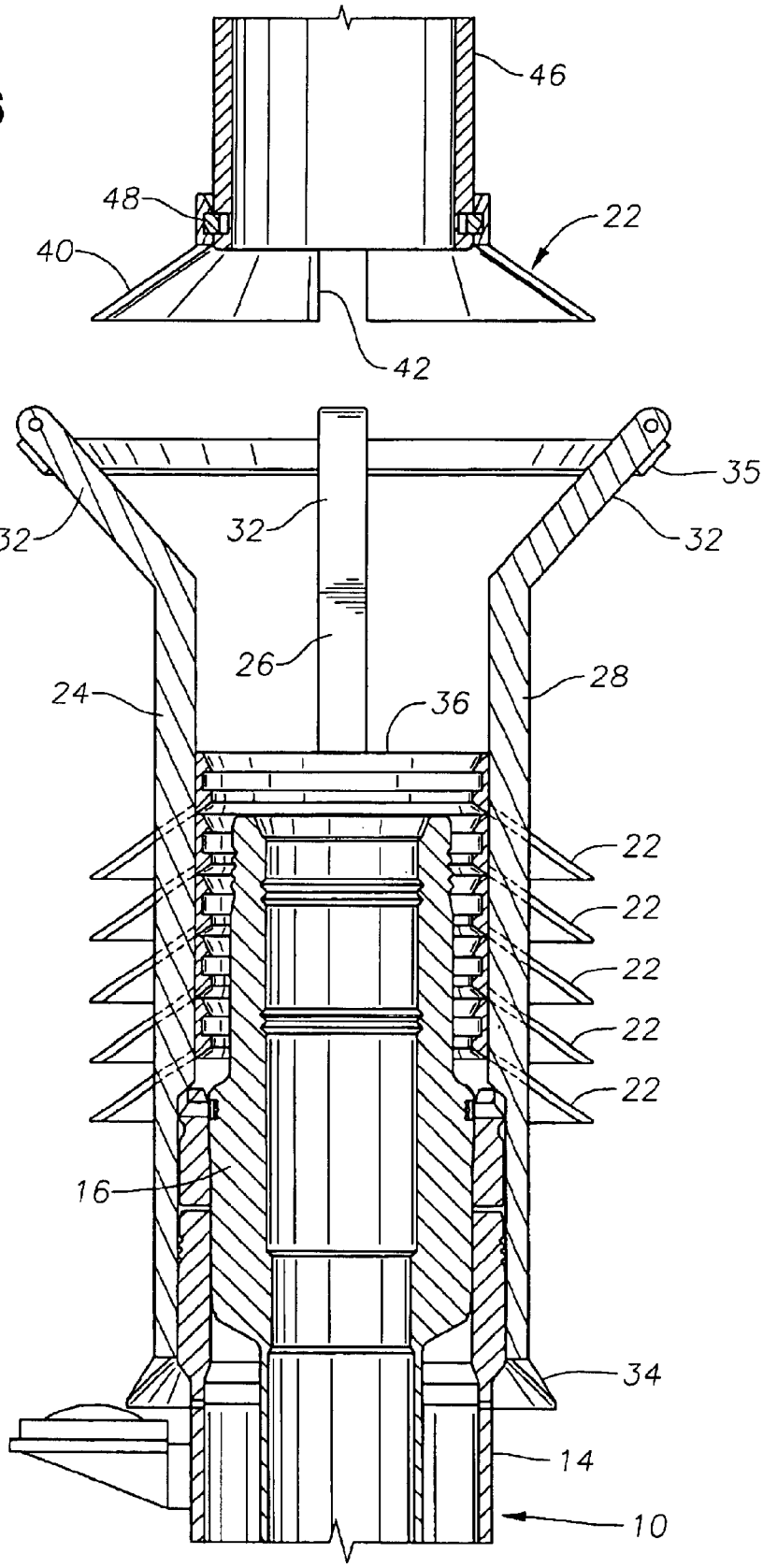
FIG. 6 is a side, cross-sectional view illustrating the riser connector having retrieved a funnel from the funnel stacking arrangement.
Figure 7:
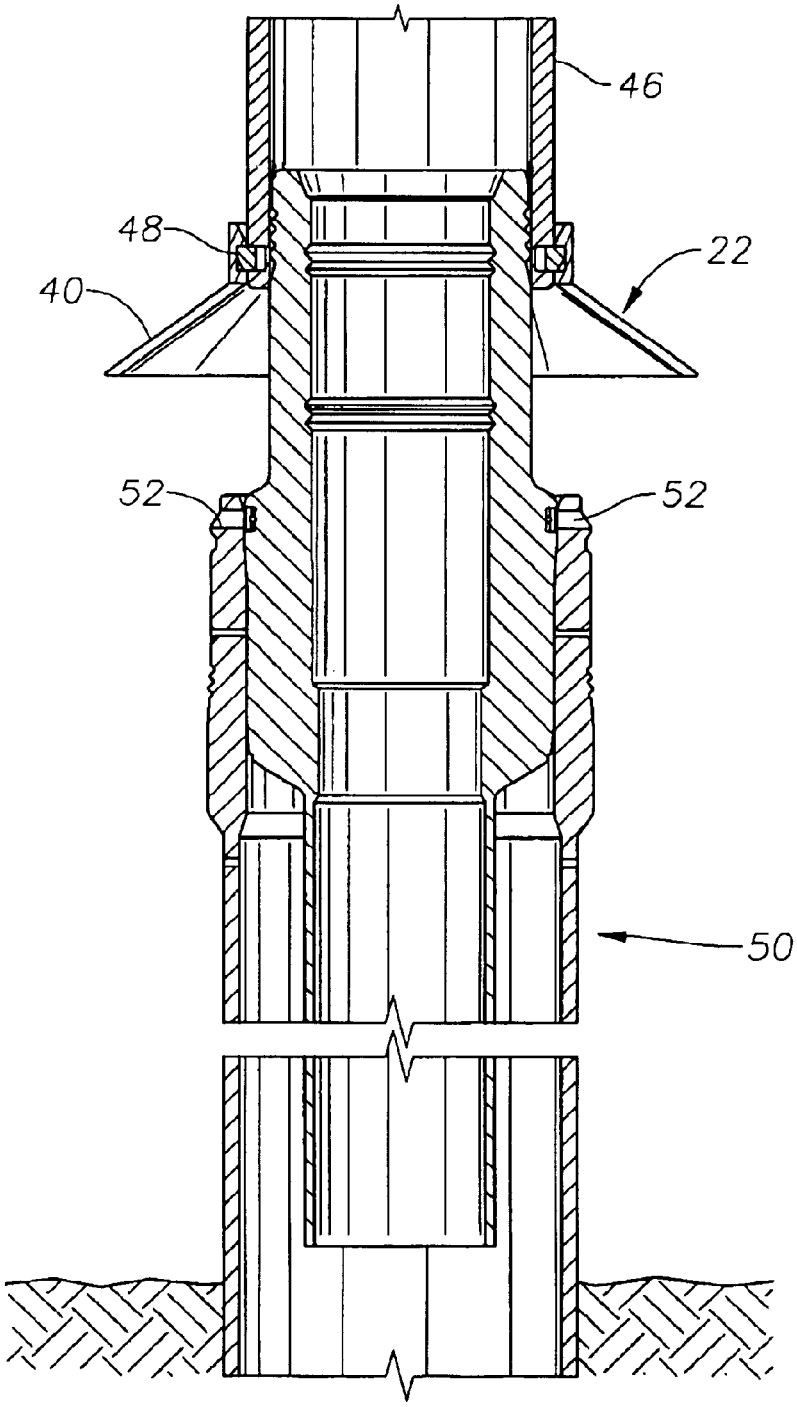
FIG. 7 depicts the riser connector landing a funnel upon a second wellhead housing.

Pulling upwardly on the riser 44 will lift the funnel 22 out of the frame 20, as shown in FIG. 6. The riser 44 is then moved to be located approximately above a second wellhead, shown in FIG. 7 as wellhead 50. The riser 44 is then lowered, permitting the wellhead 50 to encounter the funnel 22. The skirt 40 of the funnel 22 will help to guide the connector 46 toward the wellhead 50.

After the riser 44 and connector 46 have been secured to the wellhead housing 50, in the manner described, a second riser and connector (not shown) are lowered from the floating platform and caused to engage the next funnel 22 within the frame 20. The second riser is then maneuvered over to another wellhead housing (not shown), and the riser is tied in by securing of the connector to the wellhead housing. This process is repeated until a riser is connected to each wellhead housing in the field or until the funnels 22 are exhausted.

Those of skill in the art will recognize that the invention disclosed herein has been described in terms of preferred embodiments, and that many changes and modifications thereto may be made without departing from the scope and spirit of the invention. Accordingly, the invention is intended to be limited only by the following claims and their legal equivalents.

What is claimed is:

1. A subsea production system comprising:

a plurality of wellheads in a wellhead field, each of the wellheads having a tubular conductor extending from a seafloor;

a plurality of guide funnels prepositioned at a central location on the seafloor, each guide funnel being selectively securable to a lower end of a riser to assist landing of a riser with one of said wellheads;

a plurality of risers, each o the risers being selectively securable with a guide funnel;

wherein the central location further comprises a storage frame for retaining the plurality of guide funnels; and wherein the storage frame comprises:

a plurality of substantially vertically disposed keeper members; and an annular ring secured to each of the keeper members.

2. A subsea production system comprising:

a plurality of wellheads in wellhead field, each of the wellheads having a tubular conductor extending from a seafloor;

a plurality of guide funnels positioned at a central location on the seafloor, each guide funnel being selectively securable to a lower end of a riser to assist landing of a riser with one of said wellheads;

a plurality of risers, each of the risers being selectively securable with a guide funnel;

wherein each of the guide funnels comprises:

an annular ring portion; and a radially outwardly flared skirt portion; and wherein the system further comprises a riser connector affixed to a lower end of each of the risers, each riser connector having a C-ring to selectively secure one guide funnel.

3. The subsea production system of claim 2 wherein the annular ring portion of each of the guide funnels includes an internal annular groove to receive a C-ring on a riser connector.

4. A subsea production system comprising:

a plurality of wellheads each of the wellheads having a tubular conductor extending from a sea floor;

at least one of said wellhead having a funnel stacking arrangement comprising:

a frame mounted upon the tubular conductor of the wellhead; and a plurality of guide funnels removably stored within the frame, the guide funnels being shaped and sized to receive and become releasably interlocked with a riser connector.

5. The subsea production system of claim 4 wherein the guide funnels are nested in a stacked configuration within the frame.

6. The subsea production system of claim 4 wherein the frame comprises a plurality of substantially vertically disposed keeper members and an annular ring secured to each of the keeper members.

7. The subsea production system of claim 6 wherein an upper end of each of the keeper members is outwardly angled to provide a radially enlarged upper end for the frame.

8. The subsea production system of claim 4 wherein each of the guide funnels comprises an upper annular ring and an outwardly flared skirt affixed to a lower end of the annular ring.

9. The subsea production system of claim 8 wherein the upper annular ring includes an internal annular groove to receive a C-ring on a riser connector.

10. The subsea production system of claim 8 wherein the flared skirt of each of the landing funnels includes a radial slot for receiving a portion of the frame.

11. The subsea production system of claim 4 wherein each of the guide funnels comprises:

an annular ring portion having an internal groove for engagement of a complimentary latching means; and a radially outwardly flared skirt portion.

12. A method of tying back multiple wellheads in a wellhead field comprising the steps of:

preplacing a plurality of guide funnels in a central location on a sea floor;

securing a first funnel from said plurality of guide funnels to a lower end of a first riser;

moving the first riser to removed the first funnel from the central location;

landing the first riser and first funnel onto a first wellhead within the wellhead field to tie back the first wellhead.

13. The method of claim 12 further comprising the steps of:

securing a second funnel from the plurality of guide funnels to a lower end of a second riser;

moving the second riser to remove the second funnel from the central location; and landing the second riser and second funnel onto a second wellhead within the wellhead field to tie back the second wellhead.

14. The method of claim 12 wherein the step of preplacing a plurality of guide funnels further comprises disposing the plurality of guide funnels within a storage frame for sequential retrieval.

15. The method of claim 12 wherein the step of preplacing a plurality of guide funnels comprises nestably stacking the guide funnels.

* * * * *

UNITED STATES PATENT AND TRADEMARK OFFICE

CERTIFICATE OF CORRECTION

PATENT NO. : 6,766,861 B2
DATED : July 27, 2004
INVENTOR(S) : Kevin R. Koen et al.

It is certified that error appears in the above-identified patent and that said Letters Patent is hereby corrected as shown below:

Column 4,
Line 63, delete "removed" and insert -- remove --

Signed and Sealed this

Fifth Day of April, 2005

JON W. DUDAS
*Director of the United States Patent and Trademark Office*